US006988398B2

(12) United States Patent
Saloniemi et al.

(10) Patent No.: US 6,988,398 B2
(45) Date of Patent: Jan. 24, 2006

(54) METHOD AND DEVICE FOR TRACKING THE EDGE OF A WEB

(75) Inventors: Jyrki Saloniemi, Muurame (FI); Samppa J. Salminen, Jyväskylä (FI); Reijo Huuskonen, Tikkakoski (FI)

(73) Assignee: Metso Paper, Inc., Helsinki (FI)

( * ) Notice: Subject to any disclaimer, the term of this patent is extended or adjusted under 35 U.S.C. 154(b) by 201 days.

(21) Appl. No.: 10/325,272

(22) Filed: Dec. 19, 2002

(65) Prior Publication Data

US 2003/0115947 A1 Jun. 26, 2003

(30) Foreign Application Priority Data

Dec. 20, 2001 (FI) ..... 20012528

(51) Int. Cl.
*G01L 5/04* (2006.01)

(52) U.S. Cl. ..... 73/159

(58) Field of Classification Search ..... 73/159, 73/862.583; 71/862.55
See application file for complete search history.

(56) References Cited

U.S. PATENT DOCUMENTS

| | | | | |
|---|---|---|---|---|
| 4,654,546 A | | 3/1987 | Kirjavainen | |
| 5,000,032 A | * | 3/1991 | Nakashima et al. | 73/37.6 |
| 5,048,353 A | * | 9/1991 | Justus et al. | 73/862.55 |
| 5,379,652 A | * | 1/1995 | Allonen | 73/862.55 |
| 5,383,371 A | * | 1/1995 | Laitinen | 73/862.55 |
| 5,467,194 A | | 11/1995 | Pellinen et al. | |
| 5,489,784 A | | 2/1996 | Koiranen et al. | |
| 5,583,828 A | * | 12/1996 | Arai et al. | 367/118 |
| 5,592,875 A | * | 1/1997 | Moschel | 100/99 |
| 5,699,729 A | * | 12/1997 | Moschel | 100/99 |
| 5,953,230 A | | 9/1999 | Moore | |
| 6,044,717 A | * | 4/2000 | Biegelsen et al. | 73/862.583 |
| 6,433,499 B1 | * | 8/2002 | Cote et al. | 318/432 |

FOREIGN PATENT DOCUMENTS

| | | |
|---|---|---|
| EP | 0 990 883 | 4/2000 |
| FI | 86771 | 6/1992 |
| FI | 88828 | 3/1993 |
| FI | 94176 | 4/1995 |
| WO | WO 00/49379 | 8/2000 |

OTHER PUBLICATIONS

Search Report issued in Finnish Priority Application No. 20012528.

* cited by examiner

*Primary Examiner*—Edward Lefkowitz
*Assistant Examiner*—Jermaine Jenkins
(74) *Attorney, Agent, or Firm*—Stiennon & Stiennon

(57) ABSTRACT

A method and a device for tracking the position of the edge of a moving web (12), such as a fabric or a web of a paper machine, in which method a pressure-sensitive sensor element (14) is disposed in/onto the surface of the roll (10) guiding the web (12), which sensor element reacts to the pressure applied to it by the moving web (12) by producing an electric signal, on the basis of which it is possible to determine the exact position of the edge of the web (12) on the roll (10). The band-like sensor element (14) comprises one single sensor strip or several sensor strips ($14_1 \ldots 14_n$) disposed successively in the band.

21 Claims, 3 Drawing Sheets

METHOD AND DEVICE FOR TRACKING THE EDGE OF A WEB

CROSS REFERENCES TO RELATED APPLICATIONS

This application claims priority on Finnish Application No. 20012528, filed Dec. 20, 2001, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method and a device for tracking the position of the edge of a moving web, such as a fabric or a web in a paper machine.

SUMMARY OF THE INVENTION

Fabric loops running around rolls are used in paper and board machines, which fabric loops, without special guiding, may gradually drift to either edge of the rolls. A significant problem in the known systems used for fabric guiding has been the difficulty to reliably identify the position of the edge of the fabric. With increasing paper and board machine speeds, higher requirements, especially concerning the accuracy and rapidity of measurement, have been set for the fabric edge tracking systems. The provision of a reliable fabric tracking system has proven to be very difficult. The task becomes even more challenging, when the aim is to track the edge without touching it. To find a suitable location for the sensors monitoring the position of the fabric is in itself challenging. In addition, the costs often tend to become disproportionately high.

Traditionally, the fabric edge in the cross-direction of the paper machine has been tracked with a contacting guide plate. Problems associated with it are poor general performance as well as wear of the fabric edge and the plate. Detectors of the edge position based on optic, hydraulic, electric, pneumatic and acoustic operation are also known. Optic measurement based methods for contact-free tracking of the edge of a material web or fabric have been disclosed e.g. in FI patents 88828 and 94176. Disadvantages of the optic methods include that the optics tend to get dirty and that variations affecting the measurement result and the need for calibration of the measuring device occur in the colour and light transmission of the fabric. An additional risk is that, in case e.g. a shred of paper strays between the measuring head and the fabric, the measurement loses control of the situation.

An object of the invention is to provide a new and reliably operating method and device for tracking the edge of a moving web, with which arrangement it is possible to diminish problems commonly related to prior art.

In the method according to the invention, a pressure-sensitive sensor element is disposed in/onto the surface of a roll or the like, which sensor element reacts to the pressure applied to it by the moving web by producing an electric signal, whereby the exact position of the web edge on the roll can be determined based on the signals generated by the sensor element. The web being tracked may be a fabric loop, a material web or a combination of them in a paper or board machine.

A thin film- or band-type sensor is advantageously used as a sensor element, the resistance, capacitance, inductance, voltage or an optic quantity of said sensor changing as a function of pressure or force. An advantageous sensor material is described in U.S. Pat. No. 4,654,546. It is a thin and flexible electromechanical film, which is composed of a plurality of polymer layers separated from one another by air bubbles, which give the film its special characteristics. A change in the thickness of the film, generated by means of a force, creates in it a voltage proportional to the force. A permanently charged plastic film is created by charging the material electrically during the manufacturing process. Air voids inside the film make the film soft and elastic, which gives the material a very good electromechanical sensitivity. Thin plastic electrodes, laminated on both outer surfaces of the film, complete the structure of the electromechanical film.

Electromechanical film of the type described above is manufactured by EMFiTECH Ltd, and the product has been made known under the trademark EMFi™. The electromechanical film serves as a sensor when a dynamic pressure or force is exerted on it causing a local change in the thickness of the film. Since the polymer layers are stiffer than the air void layers, external pressure mainly changes the thickness of the air voids. The charges on the interfaces of the polymers and voids move relative to each other and as a consequence a mirror charge is created between the electrodes on the opposite surfaces of the film. The charge signal is thus proportional to the pore structure of the dielectric film but not to the piezoelectricity of the polymer material. The dielectric film is suitable only for dynamic force measurements due to its capacitive principle of operation. The sensitivity of the sensor can be increased by disposing several films on top of one another.

A band-like sensor element produced out of film material can be attached directly onto the surface of the roll or it can be embedded in the surface under a thin material layer. The electronics required by the measurement may be included in the film itself or they can be disposed in an electronics unit situated at the end of the roll, which unit is connected to the band-like sensor element by means of wires. This electronics unit analyses the signals coming from the sensor element. It also includes a transmitter for sending the data obtained from pressure measurement wirelessly to a stationary receiver situated near the end of the rotating roll, which receiver transmits the measurement data further to a data processing unit and to a process control device. In one embodiment there are two receivers, in which case they are placed such that, during the rotation of the roll, the first receiver receives a signal from the measurement element in a loaded state and the second receiver receives a signal from the measurement element in an unloaded state, whereby a reference value corresponding to zero loading is continuously obtained for determining the exact position of the web.

In addition to an electromechanical film, other sensor elements known in themselves and able to convert mechanical energy into electric energy, such as a capacitor band, resistance tape, parallel coupling elements, an ultrasonic film sensor or the like, may be used as a sensor element. Film sensors suitable for measuring nip pressure or nip width have been described, e.g. in publications FI 86771, U.S. Pat. No. 5,953,230 and WO 00/49379.

The sensor element band may comprise one single sensor or it may comprise several separate sensor strips placed one after another, each one of the strips giving a separate measurement signal. When the sensor element comprises several successive sensor strips spaced at a small distance from one another, the position of the web edge on the roll is determined by comparing the signals produced by the successive sensor strips with one another. When a single sensor strip placed axially in/onto the surface of the roll is used as a sensor element, the position of the web edge on the roll is determined by comparing the signals received from the loaded sensor element with the signals received from the unloaded sensor element.

In an embodiment of the invention, a sensor strip disposed spirally in/onto the surface of the roll functions as a sensor element. When the roll rotates, the sensor strip end closest to the centre of the roll always comes into contact with the web either first or last. The position of the web edge on the roll is determined based on the rotation speed of the roll, on the helix angle of the spirally disposed sensor element and on the signals produced by the sensor element. The rotation speed of the roll can be measured with the same sensor or with another device known as such.

The web edge tracking system according to the invention, in which system the pressure applied by the web to the sensor is monitored, is very reliable in operation. Placing the sensor element presents no problems, since it requires only little space. A sensor element on the surface level of the roll or embedded in the roll surface does not get dirty. The device comprises no moving parts. It withstands an unlimited number of loadings and is durable. The sensor element does not cause wear of the fabric or of the roll. The material or colour of the fabric does not affect the end result of the measurement.

BRIEF DESCRIPTION OF THE DRAWINGS

The invention will now be described with reference to the figures of the accompanying drawings, to the details of which the invention is, however, not intended to be narrowly confined.

DESCRIPTION OF THE PREFERRED EMBODIMENTS

Figure 2:
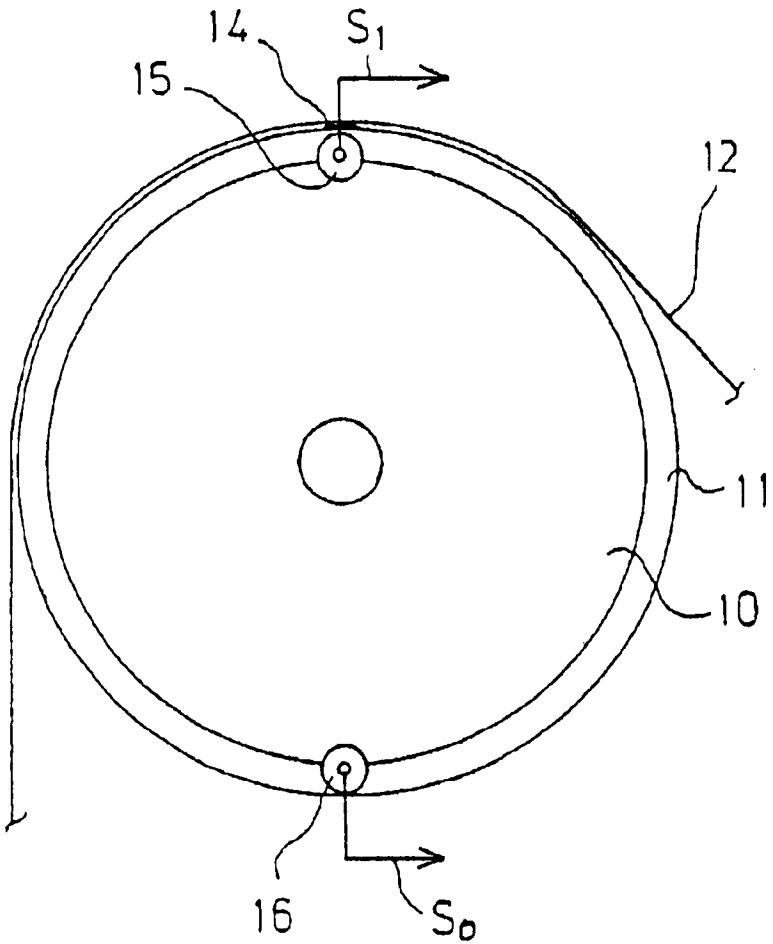
FIG. 2 is an end view of the roll of FIG. 1.
Figure 1:
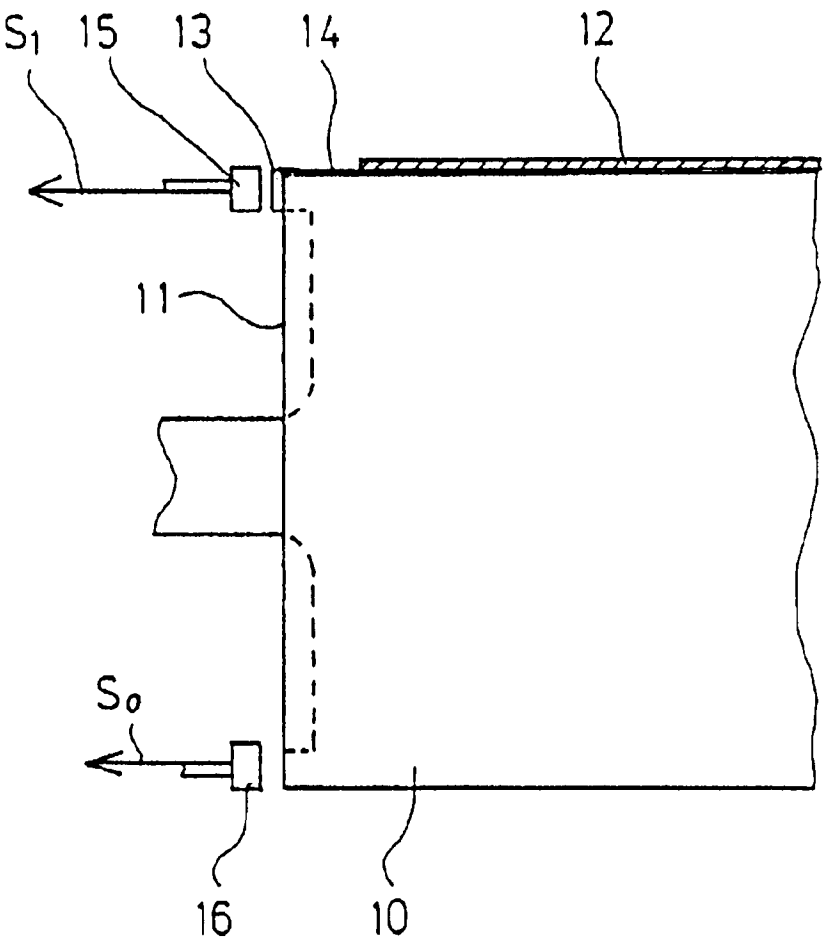
FIG. 1 is a side view of a roll equipped with a tracking device according to the invention.
Figure 3:
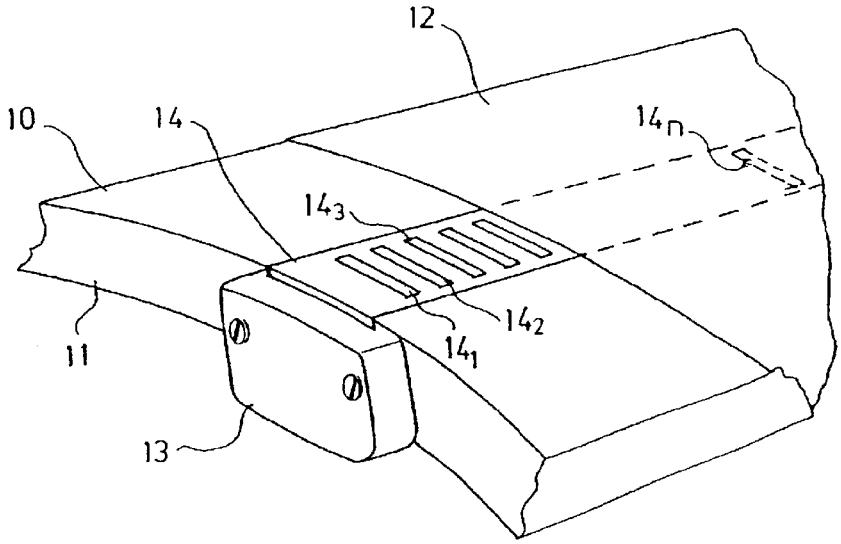
FIG. 3 is a close-up view of part of the tracking device.

FIGS. 1–3 show a device according to the invention for tracking the edge of a moving web, the device being placed in connection with a guide roll 10 guiding the run of a fabric 12. The web tracked by means of the device may be a wire or a felt or another fabric of a paper machine but also an actual paper or board web or a combination of a fabric and a web. When the fabric 12 runs over the rotating roll 10 its cross-directional position in the axial direction of the roll 10 is monitored with the tracking device according to the invention. The data obtained from the tracking is used when guiding the run of the fabric 12 with fabric guiding devices (not shown in the figures) known in themselves.

A band-like sensor element 14 extending axially from an end 11 of the roll over at least part of the length of the roll 10 is disposed in the surface of the roll 10. An electromechanical film able to convert the dynamic pressure to which the film is subjected into an electric quantity is advantageously used in the sensor element 14 as a pressure-detecting sensor. A film of this kind is known under the trademark EMFi™. An advantage of this type of film is that even very small pressures can be measured with it. Alternatively, e.g. a capacitor band, resistance tape, parallel coupling elements or an ultrasonic film sensor can be used as a sensor. The sensor element 14 can be attached directly to the surface of the roll 10 or it can be embedded in the surface of the roll 10.

The electronics required by the measurement are disposed in an electronics unit 13 situated at the end 11 of the roll 10, which unit comprises means for analysing the measurement signal coming from the sensor element 14 and means for sending a thus produced tracking signal $s_1$ wirelessly to a receiver 15 situated at a small distance from the end 111 of the roll. From the receiver 15 the tracking signal $s_1$ is passed further to an actuator (not shown in the figures) controlling the position of the fabric 12. Advantageously, near the end 11 of the roll, there is also a second receiver 16 in such a position that the sensor element 14 is always in an unloaded state when passing the second receiver 16. This means that the receiver 16 receives and transmits further a reference signal $s_0$ corresponding to zero loading.

In FIGS. 1 and 2 the sensor element 14 is made up of one single measurement sensor strip placed in the axial direction of the roll 10. The measurement data obtained from the sensor element 14 represents the pressure applied by the fabric 12 to the sensor element 14, the magnitude of which pressure depends on how big a part of the length of the sensor element 14 is left underneath the fabric 12, when the sensor element 14 and the fabric 12 meet each other. When the sensor element 14 is calibrated so as to take into account the tension and other factors of the fabric 12, the electronics of the measurement device are able to calculate how big a part of the length of the sensor element is covered by the fabric 12.

In the case of FIG. 3 the sensor element 14 comprises several successive sensor strips $\mathbf{14}_1$, $\mathbf{14}_2$, $\mathbf{14}_3$, . . . , $\mathbf{14}_n$ spaced at fixed intervals along the length of the band-like sensor element 14. Each sensor strip $\mathbf{14}_i$ generates a measurement signal representing the pressure to which the sensor element is subjected exactly at the point of the strip in question. Since the pressure changes radically at the edge of the fabric 12, the exact position of the edge on the roll 10 can be determined by comparing the signals produced by the separate sensor strips $\mathbf{14}_i$ with one another.

Figure 4:
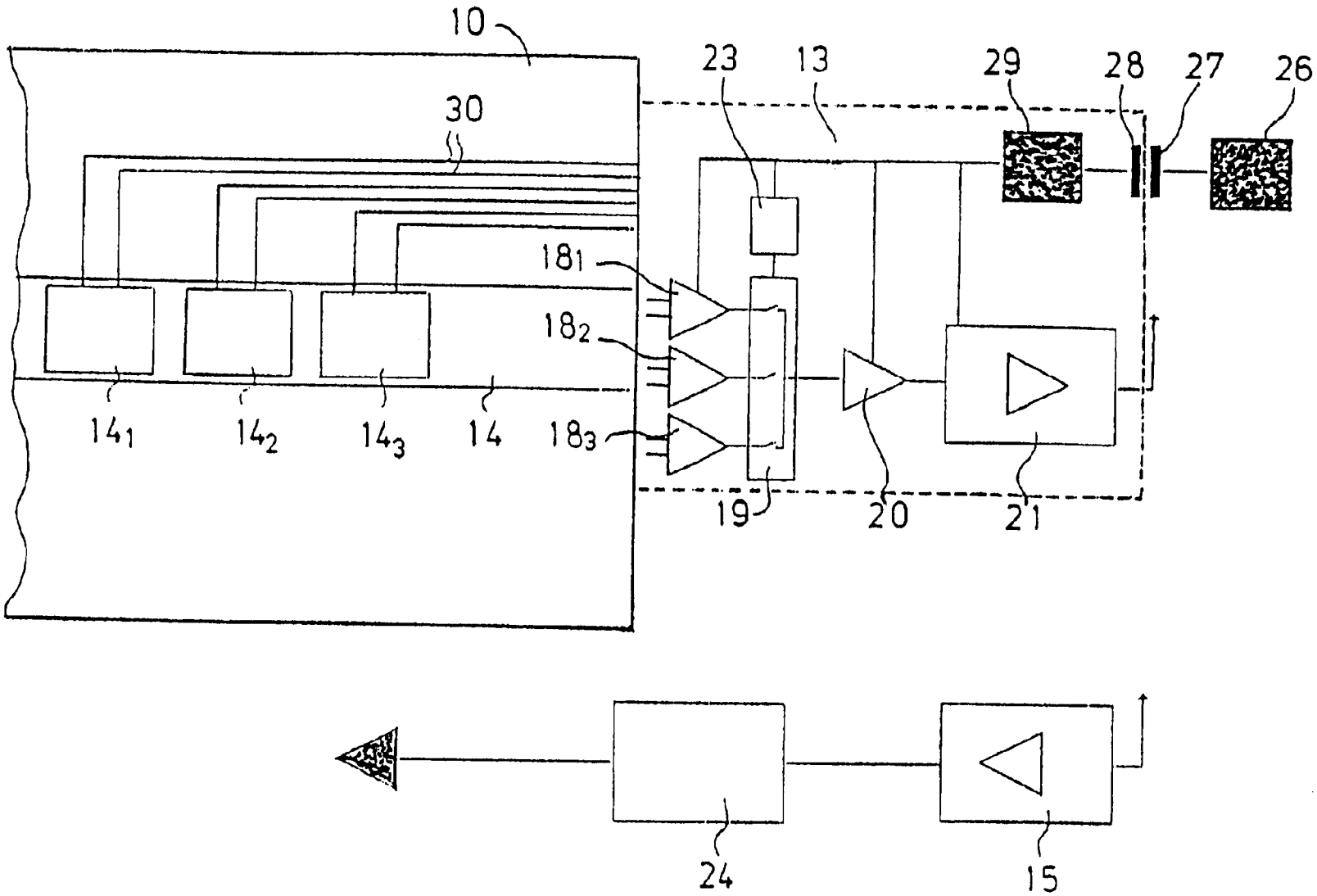
FIG. 4 is an illustration of principle of the electronics used in the tracking device.

The operating principle of the tracking system according to FIG. 3 will now be explained with reference to FIG. 4. A band-like sensor element 14 is situated in the surface of a roll 10, which sensor element comprises a plurality of sensor strips $\mathbf{14}_i$ made of electromechanical film, only the first three strips $\mathbf{14}_1$, $\mathbf{14}_2$, $\mathbf{14}_3$ being shown in the figures. The metallized upper and lower surface of each film-like sensor strip $\mathbf{14}_i$ is connected by means of a thin wire 30 to an electronics unit 13 at the end 11 of the roll. The sensor strips $\mathbf{14}_1$ . . . $\mathbf{14}_3$ react to the mechanical pressure applied to them by producing a voltage signal. These voltage signals are transmitted along the wires 30 via preamplifiers $\mathbf{18}_1$ . . . $\mathbf{18}_3$ to a multiplexer 19, which is synchronized through a synchronizing circuit 23. The multiplexed signal is passed further via an amplifier 20 to a transmitter 21, which transmits a signal $s_1$ wirelessly to a stationary receiver 15 outside the rotating roll 10. From the receiver 15 the signal $s_1$ is passed further to a data processing system 24 and from there further to process control.

Power transmission from outside the roll 10 to the electronics unit 13 rotating together with the roll is carried out wirelessly from a transmitter 27 of a power transmission unit 26 to a receiver 28 of a voltage regulator 29 and from there further via cables to the preamplifiers $18_i$, via the synchronizing circuit 23 to the multiplexer 19, to the amplifier 20 and to the transmitter 21.

Figure 5:
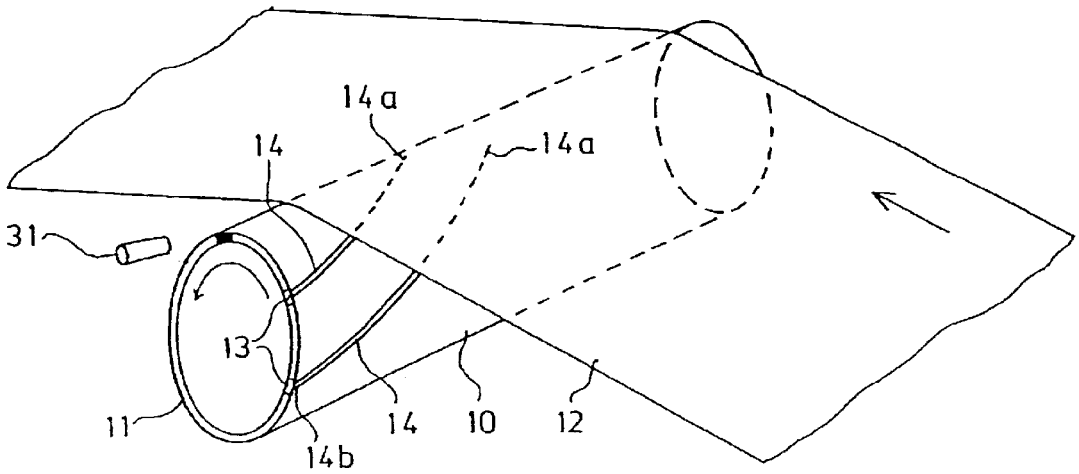
FIG. 5 shows a tracking device in which a sensor element is disposed in the form of a spiral in the surface of the roll.

FIG. 5 shows an alternative way of carrying out the tracking of the position of the edge of the fabric 12 by using one or more sensor elements 14 placed spirally in/onto the surface of the roll 10 in the fabric loop 12 such that the inner end 14*a* of the sensor element 14 extends close to the centre of the roll 10 and the outer end 14*b* of the sensor element 14 extends to the end 11 of the roll. Alternatively, the spiral can also extend along the entire length of the roll 10. As the roll 10 rotates in the direction depicted by the arrow, the sensor element end 14*a* close to the centre line of the roll comes first into contact with the fabric 12. Depending on how big a part of the sensor element 14 is covered by the fabric 12 either a voltage increasing as a function of time or a constant voltage pulse monitoring the rotation of the roll 10 is obtained as a result of pressure measurement. The sensor element head 14*a* on the side of the centre line of the roll produces a pressure pulse at the moment when it enters the nip formed by the fabric 12 and the roll 10. The voltage generated by the sensor element 14 and representing the pressure pulse ends at the moment when the part of the spiral sensor element band 14 on the side of the end 11 of the roll has rotated away from underneath the edge of the fabric 12. The rotation speed of the roll 10 is measured with a device 31, for example a pulse sensor, disposed in connection with the end 11 of the roll. Alternatively, the sensor element 14 can measure the rotation speed of the roll. The electronics associated with the measurement may be placed in the electronics unit 13 fastened to the end 11 of the roll or they may be included in the sensor element film 14 itself.

To determine the position of the edge of the fabric 12, in the case of FIG. 5, data, obtained from the spiral sensor 14, on the magnitude and duration of the voltage pulse as well as data on the rotation speed of the roll, this data being obtained from the sensor 31 measuring it, and data on the helix angle of the spiral 14 i.e. the distance it advances at a certain angle of rotation of the roll 10 are needed. The latter value is constant.

Thanks to the low cost of the sensor arrangement used in web edge tracking several sensor elements 14 can be fitted in the roll, as shown in FIG. 5. This improves the reliability of the system and enables comparison between the sensors or an automatic sensor change in problem situations.

An advantage of the arrangement according to the invention is that the electronics are very simple and inexpensive, because a simple measurement sensor can be used in it. The device is reliable in operation and able, if needed, to measure very small forces. The device does not get dirty and it withstands an unlimited number of loadings.

Although, in the arrangements illustrated above, the sensor element is disposed in/onto a roll, it is also possible, according to the invention, to dispose the sensor element in some other paper or board machine element in contact with the moving web.

The claims will now be presented, and, within the inventive idea defined by the claims, the details of the invention may vary and differ from what is presented above as exemplary only.

We claim:

1. A method for tracking position of an edge of a moving web in a paper or board making machine comprising the steps of:

detecting an electronic signal received from a pressure-sensitive sensor element positioned on an element having a surface over which the moving web travels, the electrical signal being produced by reaction of the pressure-sensitive sensor element to pressure applied to the pressure-sensitive sensor by tension in the moving web; and determining the exact position of the edge of the moving web based on the electronic signal produced by the pressure-sensitive sensor element.

2. The method of claim 1 wherein the pressure-sensitive sensor element is attached directly to the surface of the element over which the moving web travels.

3. The method of claim 1 wherein the pressure-sensitive sensor element is embedded in the surface of the element over which the moving web travels, under a thin material layer.

4. The method of claim 1 wherein the element having the surface over which the moving web travels is a roll, and the surface over which the moving web travels is the surface of the roll.

5. The method of claim 4 wherein a single sensor strip is used as the pressure-sensitive sensor element, and the strip is placed axially on the roll, whereby the position of the edge of the web on the roll is determined by comparing signals received from a loaded sensor element with signals received from an unloaded sensor element.

6. The method of claim 4 wherein a single sensor strip is used as the pressure-sensitive sensor element, the strip being placed spirally on the surface of the roll at a helix angle, and the rotation speed of the roll is measured continuously, wherein the position of the edge of the web on the roll is determined based on the rotation speed of the roll, the helix angle of the pressure-sensitive sensor element and on the signals produced by the sensor element.

7. The method of claim 4 wherein the signals produced by the sensor element are transmitted wirelessly from a transmitter at an end of the roll to a receiver situated outside the roll.

8. The method of claim 1 wherein a film or band-type sensor is used as the sensor element and wherein a property of the sensor element changes as a function of pressure applied, said property being selected from the group consisting of resistance, capacitance, inductance, voltage, and optic quantity.

9. The method of claim 1 wherein an electromechanical film is used as the sensor element.

10. The method of claim 1 wherein the pressure-sensitive sensor element is a sensor element band comprising several successive sensor strips spaced at a small distance from one another, each one of the sensor strips giving a separate measurement signal, wherein the position of the edge of the web on the element having a surface over which the moving web travels is determined by comparing the signals produced by the successive sensor strips with one another.

11. An apparatus for tracking position of an edge of a moving web in a paper or board making machine, the apparatus comprising:

a web mounted for motion in the paper or board making machine;

an element having a surface positioned with respect to the web so that the web has a tension, said tension alone applying a pressure to the element surface, so that motion of the web is over the element surface, the element surface forming a nip with the web; and a band-like electrical pressure-sensing sensor element positioned on the element, and responsive, by the production of an electrical signal, to pressure produced by the web tension when the web is moved over at least a portion of the pressure-sensing sensor element on the element, the electrical signal magnitude corresponding to the pressure applied by the web tension alone.

12. The apparatus of claim 11 wherein the band-like sensor element comprises at least one sensor strip made of film material and wherein a property of the sensor element changes as a function of pressure applied, the property being selected from the group consisting of, resistance, capacitance, inductance, voltage, and optic quantity.

13. The apparatus of claim 11 wherein the band-like sensor element comprises two or more sensor strips spaced at a small distance from one another, each sensor strip separately responsive, by the production of an electrical signal, to pressure produced by the web when it is moved over at least a portion of each sensor strip, and further comprising means for determining the position of the edge of the web by comparing the signals produced by the sensor strips with one another.

14. The apparatus of claim 11 wherein the band-like electrical pressure-sensing sensor element is attached directly to the surface of the element having the surface positioned with respect to the web so that motion of the web is over the element.

15. The apparatus of claim 11 wherein the band-like electrical pressure-sensing sensor element is embedded under a thin material layer, in the surface of the element having the surface positioned with respect to the web so that motion of the web is over the element.

16. The apparatus of claim 11 wherein the element having the surface positioned with respect to the web so that motion of the web is over the element, is a roll having a surface, and the surface positioned with respect to the web is the surface of the roll.

17. The apparatus of claim the 16 wherein the band-like electrical pressure-sensing sensor comprises a single sensor strip disposed axially on the surface of the roll, and further comprises means for determining the position of the edge of the web based on the signal produced by the sensor element.

18. The apparatus of claim 16 wherein the band-like electrical pressure-sensing sensor is disposed spirally on the roll at a helix angle, and further comprising means for measuring the rotation speed of the roll and means for determining the position of the edge of the web based on a signal produced by the band-like electrical pressure-sensing sensor, and on the helix angle of the spiral and on the measured rotation speed.

19. The apparatus of claim 16 wherein the band-like electrical pressure-sensing sensor is connected to an electronics unit disposed at the end of the roll and comprising a transmitter for transmitting a signal relating to the position of the edge of the web wirelessly from the sensor element to a receiver outside the roll.

20. A method for tracking position of an edge of a moving web in a paper or board making machine comprising the steps of:

detecting a signal received from a pressure-sensitive sensor element positioned on a roll, the roll having a surface, wherein at each instant in time as the roll rotates with the moving web, a first portion of the roll surface engages the moving web, and a second portion moves out of engagement with the moving web, the signal being produced by reaction of the pressure-sensitive sensor element to pressure applied to the pressure-sensitive sensor by the moving web when the pressure-sensitive sensor element is on the first portion of the roll surface engaging the moving web;

comparing the signal received from the pressure-sensitive sensor when the pressure-sensitive sensor is on the portion of the roll surface engaging the moving web and so subjected to pressure, with the signal received from the pressure-sensitive sensor when the pressure sensor is on the portion of the roll surface not engaging the roll and so not subjected to pressure; and determining the position of the edge of the moving web based on the signal produced by the pressure-sensitive sensor element when subjected to pressure as compared with the signal received from the pressure-sensitive sensor when the pressure sensor is on the portion of the roll surface not engaging the moving web and so not subjected to pressure.

21. The method of claim 20 further comprising transmitting the signals produced by the sensor element wirelessly from a transmitter at an end of the roll to a receiver situated outside the roll.

* * * * *